United States Patent [19]

Stone

[11] Patent Number: 4,672,504

[45] Date of Patent: Jun. 9, 1987

[54] ELECTRONIC GENERATOR FOR AIR PURIFICATION

[75] Inventor: Judson F. Stone, Northfield, Ill.

[73] Assignee: Air Physics Corporation, Northfield, Ill.

[21] Appl. No.: 904,866

[22] Filed: Sep. 8, 1986

Related U.S. Application Data

[63] Continuation of Ser. No. 768,752, Aug. 23, 1985, abandoned.

[51] Int. Cl.[4] ..... H01T 23/00

[52] U.S. Cl. ..... 361/231; 55/103

[58] Field of Search ..... 361/213, 212, 230, 231; 55/103, 128, 129, 140, 150, 151

[56] References Cited

U.S. PATENT DOCUMENTS

| | | | |
|---|---|---|---|
| 1,975,424 | 10/1934 | John | 422/186.15 X |
| 3,504,227 | 3/1970 | Wooten et al. | 361/231 |
| 3,894,852 | 7/1975 | von Berckheim | 55/150 X |
| 4,096,544 | 6/1978 | Ignatjev | 361/231 |
| 4,473,382 | 9/1984 | Cheslock | 361/231 X |

*Primary Examiner*—L. T. Hix
*Assistant Examiner*—D. Rutledge
*Attorney, Agent, or Firm*—McDougall, Hersh & Scott

[57] ABSTRACT

An electronic generator for air purification includes a molded plastic housing having a flat floor and a cover. The housing has an air inlet and a fan pulls air in through the inlet and blows it out through remote outlets. Within the housing and mounted on the floor there is a concave-convex dome made of non-conducting material and having a non-conducting outer surface. The concave surface is coated with a conductive material, and high voltage providing transformer and rectifier structure are mounted within the dome in an inaccessible position. A negative high voltage potential is applied to the conducting concave surface to establish a negative electrostatic charge over the convex surface. The air moving through the housing passes over this convex surface and negative ions are produced.

11 Claims, 8 Drawing Figures

FIG. 1
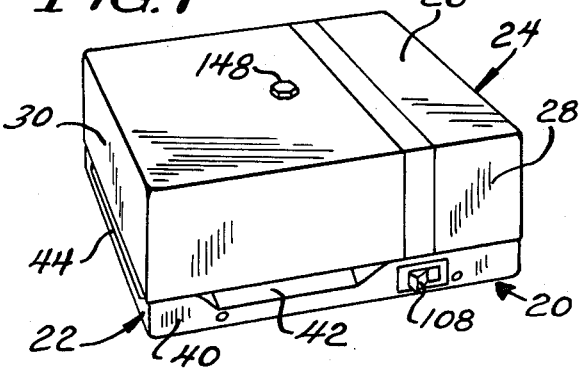
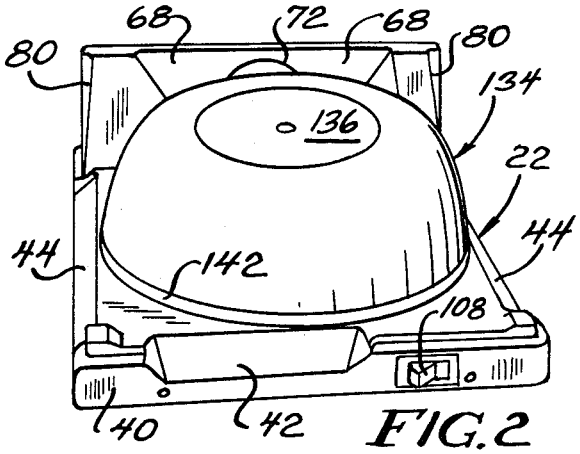
FIG. 2
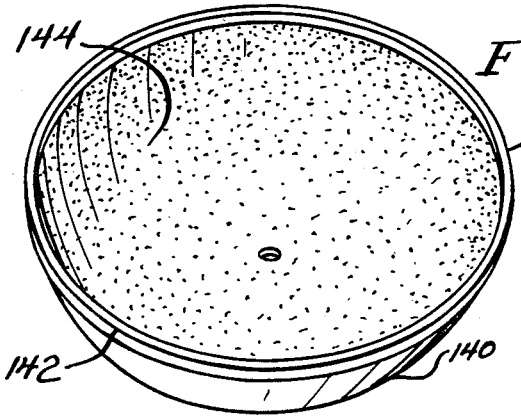
FIG. 3
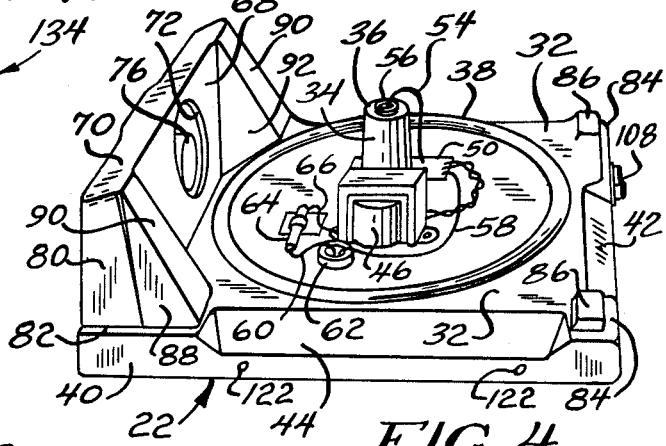
FIG. 4
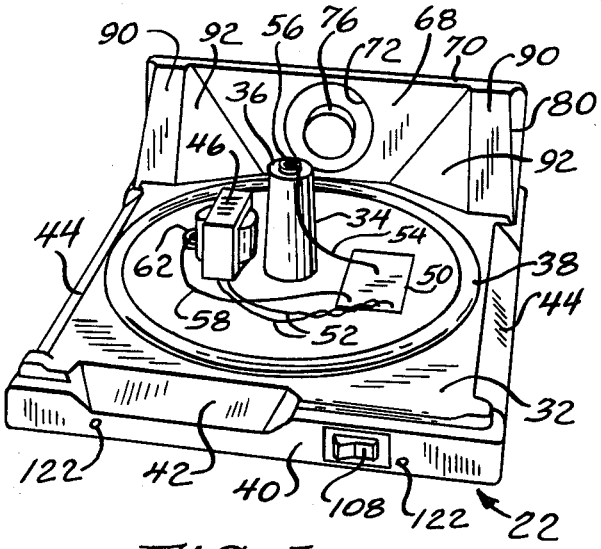
FIG. 5
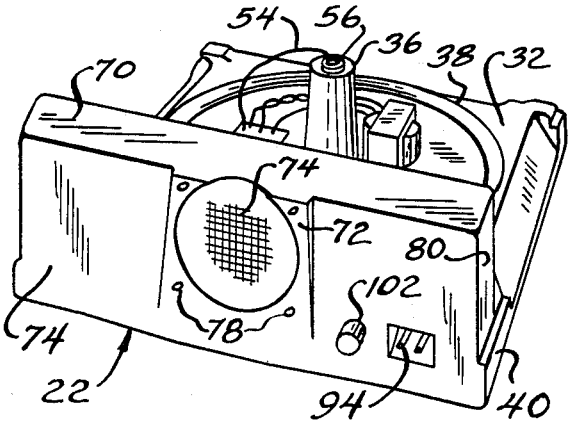
FIG. 6

FIG. 7
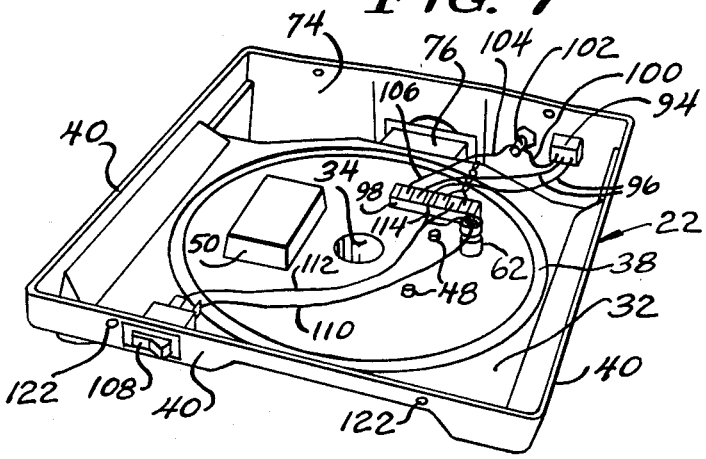
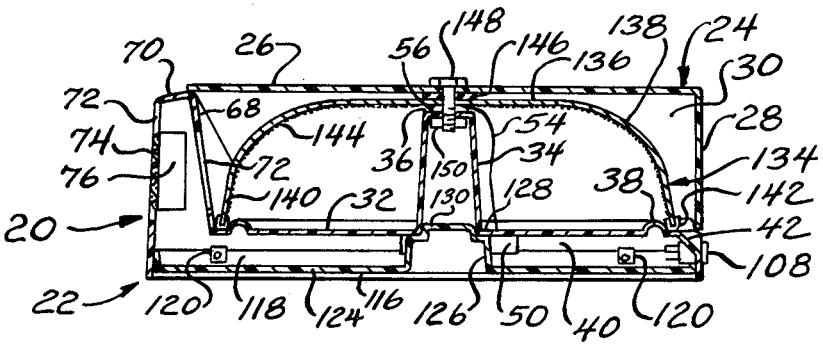
FIG. 8

ELECTRONIC GENERATOR FOR AIR PURIFICATION

This application is a continuation of application Ser. No. 768,752 filed 8.23.85 now abandoned.

BACKGROUND OF THE INVENTION

From a standpoint of static electricity it is generally considered that the earth is electrically positive. Small particles generally, such as dust, smoke, organisms in the rooms of buildings, etc., tend to be positive. Such small particles tend to be repelled by the statically positive building structures and that earth and therefore to remain in suspension in the air. Breathing of such particles is undesirable.

It previously has been recognized that generation of negative ions will cause such positive particles of dust, smoke, etc., to be attracted to the ions, and to form sufficiently large particles physically that they will drop gravitationally to the earth or floor, as well as to be negatively charged for attraction to the earth, floor or walls. Negative ions also dispel static electricity which is often troublesome.

The foregoing has been recognized in the patent art, see for example U.S. Pat. Nos. 4,037,268 and 4,109,290, and the art of record therein.

There has also been a rather significant quantity of literature generated arguing as to the beneficial physiological effects of breathing negative ions in the air. Although the physiological effects are not universally accepted they may be considered as a possible bonus to the accepted physical effects of removing particulate material from the air.

OBJECTS AND SUMMARY OF THE INVENTION

It is an object of the present invention to provide an improved electronic generator for air purification, and specifically for the production of negative ions.

It further is an object of the present invention to provide such an electronic generator which is electrically safe and which avoids the generation of ozone which is considered to be unhealthy for breathing and to have physical deleterious effects.

In accordance with the present invention an air purifier is provided which has a motor driven fan for circulating air. A housing is provided through which the air is circulated, and a large dome is housed within the housing. The dome is made of plastic or other insulating material and is hermetically sealed to a base within the housing. All of the high voltage portions of the air purifier are disposed under the dome and hence in an inaccesible position, thereby assuring electrical safety. The inner surface of the dome is covered or coated with an electrically conductive material and a negative high voltage DC source is connected to the coating. This produces a negative electrostatic field over the entire outer surface of the dome. Movement of air over the outer surface of the dome as caused by the fan causes air particles to become negatively ionized. There are no conductive materials accessible to the moving air, and there hence are no areas on which dirt or other particulate material could build up to cause points where there might by a Corona discharge which would generate ozone, the latter being highly undesirable.

THE DRAWINGS

The present invention will best be understood from the following specification when taken in connection with the accompanying drawings wherein:

FIG. 1 is a perspective view of an electronic generator as constructed in accordance with the present invention;

Fig 2 is a perspective view similar to FIG. 1 with the cover of the housing removed;

FIG. 3 is a perspective view on an enlarged scale of the dome previously shown in FIG. 2, in an inverted position;

FIG. 4 is a perspective view of the base of the housing with the dome removed, taken substantially at right angles to FIGS. 1 and 2;

FIG. 5 is a perspective view of the base generally similar to FIG. 4 and taken substantially at right angles thereto;

FIG. 6 is another perspective view of the base of the housing taken at substantially 180 degrees relative to FIG. 5 and showing what might be considered to be the rear side of the base;

FIG. 7 is an inverted view of the base taken from the same direction as FIG. 5 and with the floor removed and;

FIG. 8 is a cross-section through the base and dome as taken substantially along the line 8—8 in FIG. 2.

DESCRIPTION OF THE PREFERRED EMBODIMENT

Turning now in greater particularity to the drawings there will be seen an electronic generator 20 for air purification as constructed in accordance with the principles of the present invention. The air purifier is generally rectangular in shape and includes a base 22 and a top housing or cover 24. The housing is rectangular, nearly square in outline, and includes a top wall 26, a front wall 28 at right angles thereto, and a pair of sidewalls 30. The back is open as will appear shortly.

The base 22 includes a generally flat floor 32 having an upstanding central boss 34 which comprises a frustum of a cone tapering at a shallow angle, and being terminated and substantially closed at the upper end by a horizontal wall 36. This wall is apertured for receipt of a bolt as hereinafter described, and may be threaded. An annular rib 38 is spaced out from the boss 34 and upstands from the surface of the floor 32.

The floor 32 of the base 22 is provided on the front and both sides with a depending flange 40. Portions of the junctions of this flange with the floor are relieved at 42 at the front, and at 44 on the sides. This provides vents for egress of ionized air from within the purifier as will be apparent hereinafter.

The floor 32 has a transformer 46 upstanding therefrom and secured by screws or the like 48 (FIG. 7) extending through the floor from the underside thereof and threaded into suitable portions of the transformer. A suitable high voltage rectifier circuit is mounted in a well 50 in the floor and may be potted in place. Suitable wires 52 extend between the transformer and the rectifier, and a single high voltage wire 54 extends from the rectifier unit to a terminal or washer 56 resting on the horizontal wall 36 at the top of the boss 34. A pair of wires 58 and 60 extend through a grommet 62 fitting through a hole in the floor 32. The wires are sealed in the grommet in a suitable plastic or rubber compound so that the floor is effectively sealed. The wire 58 leads to the rectifier unit 50 and may be considered a ground wire, being returned through one of the wires 52 to the transformer 56. The other wire 60 extends to a fuse 64 suitably mounted on the floor 32 and a wire 66 leads from the other end of the fuse to the second lead to the transformer 46. The transformer, as will be understood, is connected to the usual 120 volt line by wires hereinafter to be mentioned and provides a high voltage output to the rectifier unit 50 which then supplies a high voltage direct current out on the wire 54 to the washer or terminal 56. The high voltage direct current is on the order of 6,000 to 10,000 volts, and the polarity on the wire or lead 54 is negative.

At the rear of the floor 32 there is an upstanding wall 68 which inclines slightly outwardly as it moves up from the floor. The wall 68 is surmounted by a narrow top wall 70. The wall 68 is provided centrally with a circular aperture 72. A depending rear wall 74 extends down to a level with the side flanges 40 and is provided with a central flat portion 72 closed by a screen or grill 74. A muffin fan 76 is secured behind the screen 74 such as by screw threaded fasteners 78 extending through the flat central portion 72 of the wall 74. As is known, a muffin fan includes an electric motor and a blower which may be of the blade or centrifugal type. The fan 76 pulls in outside air through the screen 74 and expels it into the interior of the generator through the opening 72 in the wall 68.

Vertical end walls 80 interconnect the rear wall 68, the top wall 70 and back wall 74 and extend down to the top of the floor 32, including rearward extensions thereof, leaving a narrow ledge 82 outwardly of each wall 80 for the respective sidewalls 30 of the top cover to rest on. At the front corners of the base there are additional ledges 84 coplanar with the ledges 82 and with the floor 32 on which the front wall 28 and the front portions of the sidewalls 30 of the cover rest. Upstanding bosses 86 adjacent the ledges 84 position the front corners of the cover 24.

The walls 80 are provided with inset tapered, bracing walls 88 extending to the floor 32. Diagonal walls 90 extend between the walls 88, the floor 32 and the top wall 70, while inset or gussetted walls 92 join the walls 90 to the upstanding wall 68 and to the floor 32.

All of the parts of the base as heretofore shown and described comprise a single vacuum formed plastic member. A separable electrical connector 94 is provided in the back wall 74 and has electric wires 96 leading therefrom to a terminal block 98 suitably secured to the underside of the floor 32. Another wire 100 leads to a fuse 102 also mounted in the back wall 74. The opposite terminal of the fuse is connected by a wire 104 to the muffin fan 76, specifically the motor thereof. The other wire 106 from the fan motor is connected to the junction block 98. An on-off rocker switch 108 is mounted in the front flange 40 and has one wire 110 therefrom extending into the grommet 62, while the other wire 112 therefrom extends to the junction block 98, there being a second wire 114 from the junction block into the grommet 62, these wires continuing at the inner end of the grommet as the wires 58 and 60 previously referred to.

A bottom plate 116 underlies the floor 32 and is spaced therefrom, and is provided with an upstanding peripheral flange 118 having suitably positioned sheet metal nuts 120 clipped thereon, appropriate apertures being formed in the flange 18 for receipt of the sheet metal nuts 120. Screw fasteners extend through aligned apertures 122 in the front and side flanges 40 for passage of screws which are threaded into the sheet metal nuts 120 to secure the bottom plate 116 in position. The bottom plate comprises another integral sheet plastic vacuum formed member, and includes a central rib 124 extending from the front to the back of the base 22. A central boss 126 upstands from the rib 124, and the rib will be understood as for bracing purposes. The central boss 126 is of larger diameter than the boss 34, and has an upper wall 128 underlying and bracing the floor 32. A central protuberance 130 of the boss 126 extends upwardly within the boss 134 a short distance for relative location of the parts.

A further important element of the present invention comprises a power dome 134. This dome may be of different selected concave-convex shapes, and in the present illustrative embodiment comprises a generally flat top 136 with a downwardly curved shoulder portion 138 leading to a downwardly and outwardly diverging frusto-conical wall 140. A rubber or plastic gasket 142 having a U-shaped cross section fits over the lower edge or perimeter of the power dome 134 and seals the dome to the floor 32. The lower edge of the dome with the gasket thereon lies close against the outer periphery of the rib 38, the gasket thereby also sealing the dome to the outer periphery of the rib.

An important aspect of the present invention is that the dome 134 is formed of a suitable non-conductive material. As a practical expedient for production purposes the dome is molded of a suitable plastic material, although it also could be made of a wood product, or turned from solid wood. The entire inner surface of the dome is coated with an electrically conductive coating 144. The coating can be a metal foil adhesively secured in place. It can be metal electroplated, sputtered, or painted in place, or it can be any suitable conducting material. A specific example includes the graphite suspension known as aquadag presented on the inner or concave surface of the dome.

The dome and the boss 34 are relatively positioned such that the conductive coating 144 on the inner surface of the dome 134 presses down against the washer 56 when the dome is in place on the floor 32 to apply a negative high voltage to the conductive surface. This causes a negative high voltage electrostatic potential to overlie the outer or convex surface of the dome. The dome as will be seen covers the transformer, the fuse, and the high voltage rectifier unit, whereby all of the high voltage is completely sealed from prying fingers or conductive objects. A plastic or rubber spacer in the nature of a washer 146 spaces the top 26 of the cover 24 away from the top 136 of the dome 134. An insulating bolt 148, such as made of a suitable plastic material, extends through aligned holes in the top wall 26, and through the dome, and through the respective washers. The bolt may be threaded into the top wall 36 of the boss 34, and preferably there is a suitable nut member 150 secured beneath this wall for receipt of the bolt.

As will be seen in FIGS. 1 and 8 particularly there are spaces between the lower edge of the sidewalls 28 and 30 of the cover and the relieved areas 42 and 44 of the base. Thus, air drawn into the electronic generator by the muffin fan 76 is blown over the outer surface of the dome 134 and out through the relieved areas 42 and 44 beneath the lower edge of the cover wa11s. The air comes into contact only with non-conductive plastic material. However, with the high voltage direct current potential connected to the conductive coating on the inner surface of the dome there is a high potential electrostatic field established over the entire outer surface of the dome. The air passing over the outer surface therefore becomes negatively charged. Particulate matter in the air becomes negatively charged, and negative ions are released in the air. The negatively charged particles tend to agglomerate due to adherence thereof in their normally positive state with the negative ions, whereby the negative charge and gravity cause deposition of such particles on the ground, the floor, and on walls, etc. The particulate material therefore is removed from the air for cleaner air for breathing. Static electric charges are dispelled. There is also literature supporting the contention that the negatively charged ions are physiologically good for people to breath.

There is no high voltage conductive material with which the air comes into contact. It therefore is not possible for particulate matter in the air to deposit on such a conductive material to form points or high spots that could lead to arcing and ozone generation. The deleterious effects of ozone on human beings are well recognized, as are the color bleaching and deterioration of fabric and other materials with which the ozone comes in contact.

As has been indicated major portions of the electronic generator are molded of a suitable plastic material (sometimes known as platic resin material, or resinous plastic material), whereby the purifier can be made relatively inexpensively. Other structure for connecting the high voltage lead wire to the conductive convex surface of the dome such as taping a stripped portion of the wire to the conductive surface, or securing the wire to a metal tape secured to the conductive surface with a conductive adhesive. Other structure also can be used to secure the cover to the base.

The purifier can be placed on a horizontal supporting surface, where it may be supplied with a suitable device for hanging it on a wall in a relatively out of the way position. One specific embodiment is approximately thirteen by fourteen inches in outline with other dimensions scaled approximately as shown in the drawings.

The specific example of the invention as herein shown and described is for illustrative purposes. Various changes in structure will no doubt occur to those skilled in the art, and will be understood as forming a part of the present invention insofar as they fall within the spirit and scope of the appended claims The invention is claimed as follows:

1. An electronic generator for air purification including a polygonal housing having a substantially flat base and a cover having a top wall, the height of said cover being substantially less than the transverse dimensions of said housing, air inlet means at one extremity of said housing, air outlet means from said housing remote to said air inlet means, fan means moving air through said housing from said inlet means to said outlet means, a concave-convex dome within said housing having a non-conducting outer convex surface over which air moves from said inlet means to said outlet means, a conductive concave surface on the inside of said dome, said dome having a height substantially less than one-half the transverse dimension thereof, the top of said dome being spaced from the top wall of said cover and providing air passage means from said air inlet means to said air outlet means, high voltage means in said housing and providing a negative high voltage connected to said conductive surface and producing a negative high voltage electrostatic charge adjacent said convex surface.

2. A generator as set forth in claim 1 wherein said non-conducting surface providing means comprises a non-conducting member having an opposite surface, and said electrically conducting means comprising a coating of conductive suspended material on said opposite surface.

3. A generator as set forth in claim 2 wherein said suspended material comprises carbon.

4. A generator as set forth in claim 1 further including a panel having a non-conducting member outstanding therefrom centrally of said dome, and means securing said dome to said member.

5. A generator as set forth in claim 1 wherein said high voltage means is mounted within said dome.

6. A generator as set forth in claim 1 and wherein said dome has a substantially flat top and said cover top wall is substantially flat and parallel to said dome flat top.

7. An electronic generator for air purification including a housing defining a base, a cover, and surrounding side walls, air inlet means defined by said housing, air outlet means defined by said housing remote to said air inlet means, fan means for moving air through said housing from said inlet means to said outlet means, a concave-convex dome positioned on said base within said housing, said dome being formed of a non-conductive material and thereby defining a non-conductive outer surface for contact by the air moving from said inlet means to said outlet means, a substantially uninterrupted layer of conductive material substantially completely covering the concave inside surface of said dome, and high voltage means connected to said conductive material layer for thereby producing a negative high voltage electrostatic charge spread over said non-conductive outer surface.

8. A generator as set forth in claim 7 wherein said high voltage means is disposed within said dome.

9. A generator as set forth in claim 8 wherein said dome is pressed against said base for sealing the interior of said dome with respect to the interior of said housing.

10. A generator as set forth in claim 7 including a base portion extending upwardly within said dome, and including means securing said base portion to said dome for maintaining said dome in position on said base.

11. A generator in accordance with claim 7 wherein said dome is formed of plastic material with the exterior surface thereof providing said non-conductive outer surface and with said conductive material comprising a graphite coating formed on said inside surface.

* * * * *